US005927578A

United States Patent [19]

Kay

[11] Patent Number: 5,927,578

[45] Date of Patent: Jul. 27, 1999

[54] FIREARM WITH TRIGGER LOCK GUARD

[75] Inventor: Ira M. Kay, Warrenton, Va.

[73] Assignee: Colt's Manufacturing Company, Inc., Hartford, Conn.

[21] Appl. No.: 09/086,092

[22] Filed: May 28, 1998

[51] Int. Cl.[6] ..... F41C 33/02

[52] U.S. Cl. ..... 224/244; 42/70.07

[58] Field of Search ..... 42/94; 224/244

[56] References Cited

U.S. PATENT DOCUMENTS

| | | | |
|---|---|---|---|
| 3,645,428 | 2/1972 | Angell | 224/2 B |
| 3,866,811 | 2/1975 | Hamby | 224/2 B |
| 4,277,007 | 7/1981 | Bianchi et al. | 224/193 |
| 4,318,503 | 3/1982 | Capano | 224/244 |

*Primary Examiner*—Charles T. Jordan
*Assistant Examiner*—Meena Chelliah
*Attorney, Agent, or Firm*—Perman & Green, LLP

[57] ABSTRACT

The invention relates to a lock system for firearms whereby an inexpensive, reliable and easy to use locking system is provided as part of a firearm and involves the formation of an opening formed in a strategically located part of the trigger assembly. The opening is appropriately sized and shaped to receive a conventional standard lock having a movable shank which is open and placed through the strategically placed opening in the trigger assembly and thereafter locked in place to affect the inoperative condition of the firearm. The lock can also be mounted as part of a holster which prevents inadvertent firing and removal of the firearm.

2 Claims, 10 Drawing Sheets

FIREARM WITH TRIGGER LOCK GUARD

BACKGROUND OF THE INVENTION

1. Field of the Invention

The present invention relates to a firearm safety device and more particularly to a trigger lock system which prevents access to the firearm by an unwanted user.

2. Prior Art

Lock systems which are provided as part of a firearm are generally well known. Such guard or lock systems are not exclusive to any one type of firearm, but rather cover a wide scope and range of firearms. Such patents covering these devices are set forth below as follows:

| U.S. Pat. No. | Issue Date |
|---|---|
| 5724760 | 3/10/98 |
| 5395021 | 3/7/95 |
| 5367811 | 11/29/94 |
| 5275317 | 1/4/94 |
| 5048212 | 9/17/91 |
| 4925075 | 5/15/90 |
| 4277007 | 7/7/81 |
| 3964200 | 6/22/76 |
| 2590516 | 3/25/52 |
| 2503953 | 4/11/50 |
| 2401482 | 6/4/46 |

As is illustrated in U.S. Pat. No. 5,367,811, highly complex designs for locks have been used to create a safety guard to protect against inadvertent firing of a firearm. However, such locks are quite complicated to operate as well as being expensive to make. Likewise for example, in U.S. Pat. No. 2,590,516, a trigger safety for firearms is disclosed which uses a hinged cover 18 designed to slide over the trigger guard. The cover further includes a pin 88 which is secured to the rim of the cover and extends through an opening in the guard when the cover is brought into operative position. However, the hinged cover guard disclosed in U.S. Pat. No. 2,590,516 requires the permanent securement of the cover onto the frame of the firearm.

Accordingly it is an object of the invention to provide a trigger guard which prevents inadvertent firing of a firearm by locking the trigger against movement using simplified low cost technology.

A further object of the invention is to provide a trigger lock system which is capable of selectively locking the trigger against inadvertent firing such that the trigger lock system is made to be reliable and uncomplicated.

Other objects and advantages of the invention will become apparent from the following specification and appended claims.

SUMMARY OF THE INVENTION

The invention relates to a lock system for firearms whereby an inexpensive, reliable and easy to use locking system is provided as part of a firearm and involves the formation of an opening formed in a strategically located part of the trigger assembly. The opening is appropriately sized and shaped to receive a conventional standard lock having a movable shank which is open and placed through the strategically placed opening in the trigger assembly and thereafter locked in place to affect the inoperative condition of the firearm.

More specifically, the invention resides in a firearm comprised of a trigger guard formed on a firearm having an outer surface and an inner surface defining a given thickness of the trigger guard. A trigger member is pivotally mounted within a cavity of the firearm and is movable through an arc between a prefired position and a fired position along a given arc of movement. A discharge preventing opening is formed in the trigger guard transversely through the inner and outer surfaces of the trigger guard and in communicating therewith. The discharge preventing opening is positioned substantially proximate the first position of the trigger member. A lock member is provided which has a shank which extends through the discharge preventing opening in the trigger guard so as to be disposed substantially perpendicular thereto and secured in place by a releasable lock to cause blocking of the trigger member through the arc between the first and second positions of the trigger.

Ideally, the lock member has a substantially U-shaped shank member which is passed through the discharge preventing opening and locked in place on the trigger guard and the generally U-shaped shank member has a radius of curvature which is sufficient to interfere with the moving action of the trigger member between the first and second positions.

In another embodiment of the invention, the firearm comprises a trigger member connected to the firearm and movable through an arc between a first prefired position and a second fired position. The trigger member is comprised of an integrally formed boss portion and a depending trigger piece which is engageable by a digit of the hand of a user. The trigger member is pivotally mounted on a frame defining the firearm, and the boss portion being positioned generally adjacent a juxtaposed region of the frame. The boss portion of the trigger member having opposite parallel flat sides through which is formed a transversely extending discharge preventing opening extending therethrough and communicating with the opposite sides of the trigger boss. The discharge preventing opening being formed in the boss portion so as to be located substantially tangently with the juxtaposed region of the frame when the trigger member is in the first prefired condition.

In still another embodiment of the invention, the firearm comprises a trigger member having an upper end and a lower end, and which trigger member is pivotally mounted to a frame. A trigger guard is connected to the frame and surrounds the trigger member generally proximately the lower end of the trigger member. The trigger member is movable between a first prefired condition and a second fired condition such that the trigger member moves between the first and second positions to cause firing of the firearm. The trigger member further having a first surface and an opposed second surface, the first surface defining an engagement surface for the pulling digit of the hand of a user and the second surface defining a rear surface thereof. A discharge preventing opening is formed through the trigger member generally proximate the lower end thereof and opening at the first and second faces of the trigger member, respectively, at an angle generally normal to the first surface.

Desirably a lock is secured through the discharge preventing opening such that the shank jams between the second surface of the trigger and the trigger guard to prevent firing of the firearm.

In yet another embodiment the firearm comprises a slide action trigger disposed on a frame defining the outline of the firearm, the slide trigger being disposed within a cavity thereof for movement between a first extended prefired condition position and a second retracted fired condition position. The slide trigger has opposite first and second sidewalls defining a given thickness of the trigger. A discharge preventing opening is formed transversely through the thickness of the slide trigger in communication with each of the opposite first and second sidewalls and wherein the discharge preventing opening being disposed on the slide trigger such that when the slide trigger is in the first position the discharge preventing opening is located tangentially with the frame of the firearm.

Preferably, the discharge preventing opening having an annular chamfer formed therearound and a lock having a generally U-shape shank which is placed through the discharge preventing opening and is secured by a lock mechanism against the movement.

In another embodiment of the invention, a holster comprises a housing defining generally a chamber which is shaped to receive the corresponding shape of a firearm. A lock mechanism is disposed on the holster generally adjacent the point where the trigger guard of a firearm would be located when a firearm is seated within the chamber. The lock mechanism has a spring loaded bell crank which is biased inwardly toward the chamber and includes a projection portion thereon which is displaceable between an outwardly extending position corresponding to a locked condition of the lock mechanism and an inwardly retracted position corresponding to when a firearm is being moved into place within the holster.

Ideally the lock mechanism bell crank is an S-shaped bell crank which has an angled face which faces the opening of the chamber when a firearm is being placed therein.

DETAILED DESCRIPTION OF THE PREFERRED EMBODIMENT

Figure 1:
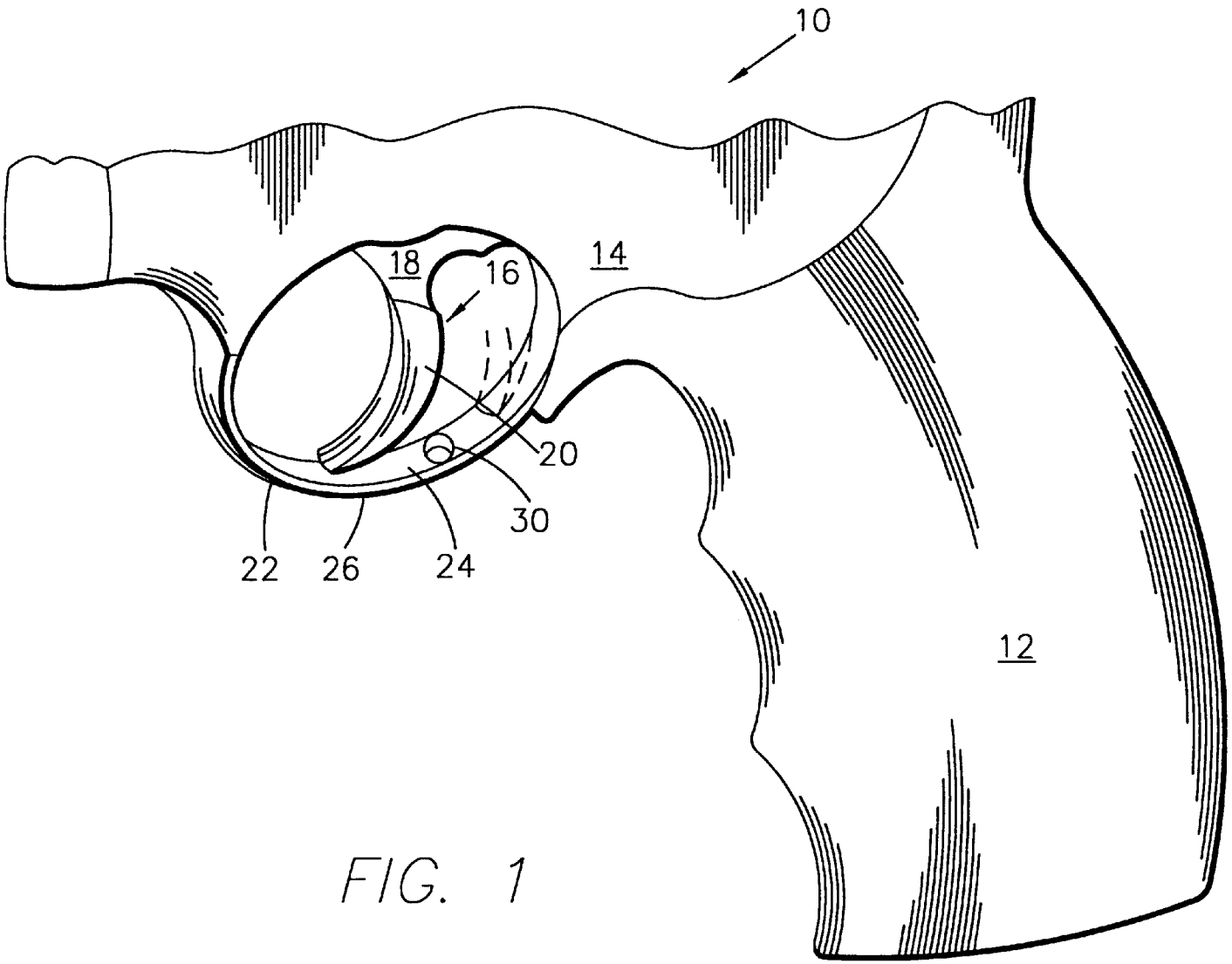
FIG. 1 is a partially fragmentary perspective view of a firearm with a discharge preventing opening formed in the trigger guard.

Referring to FIG. 1, there is shown a perspective view of a firearm 10 incorporating the features of the present invention. Although the present invention will be described with reference to a hand gun e.g., pistol or revolver shown in the drawings, it should be understood that the present invention can also be embodied in many alternative forms and embodiments, such as with trigger assemblies of rifles or the like. Also any suitable size, shape or type of elements or materials other than discussed herein can be substituted.

The firearm 10 includes a handle 12, a frame 14 on which a barrel (not shown) is secured. The frame also includes a trigger mechanism housed within an internal cavity and is connected to a pivotal trigger member 16. The trigger member 16 is defined by a boss 18 which extends through into the frame and connects with the internalized trigger mechanism and a depending trigger piece 20 about which the user places the firing digit of the hand. As shown in FIG. 1, the trigger is in its forwardmost location coinciding with the nonfiring or latent condition of the gun. Also the trigger piece 20 is enclosed by a trigger guard 22 which is contiguously formed as part of the frame 14 of the firearm.

The trigger member 16 is movable between the forwardmost illustrated position shown in the figures, and a rearmost position associated with the fired mode of the firearm. This second fired position of the trigger member illustrated in phantom line is shown located proximate the trigger guard adjacent the gun handle 12. It is in this general area that the internal trigger mechanism causes the hammer to strike the shell and discharge the chambered round.

Figure 2:
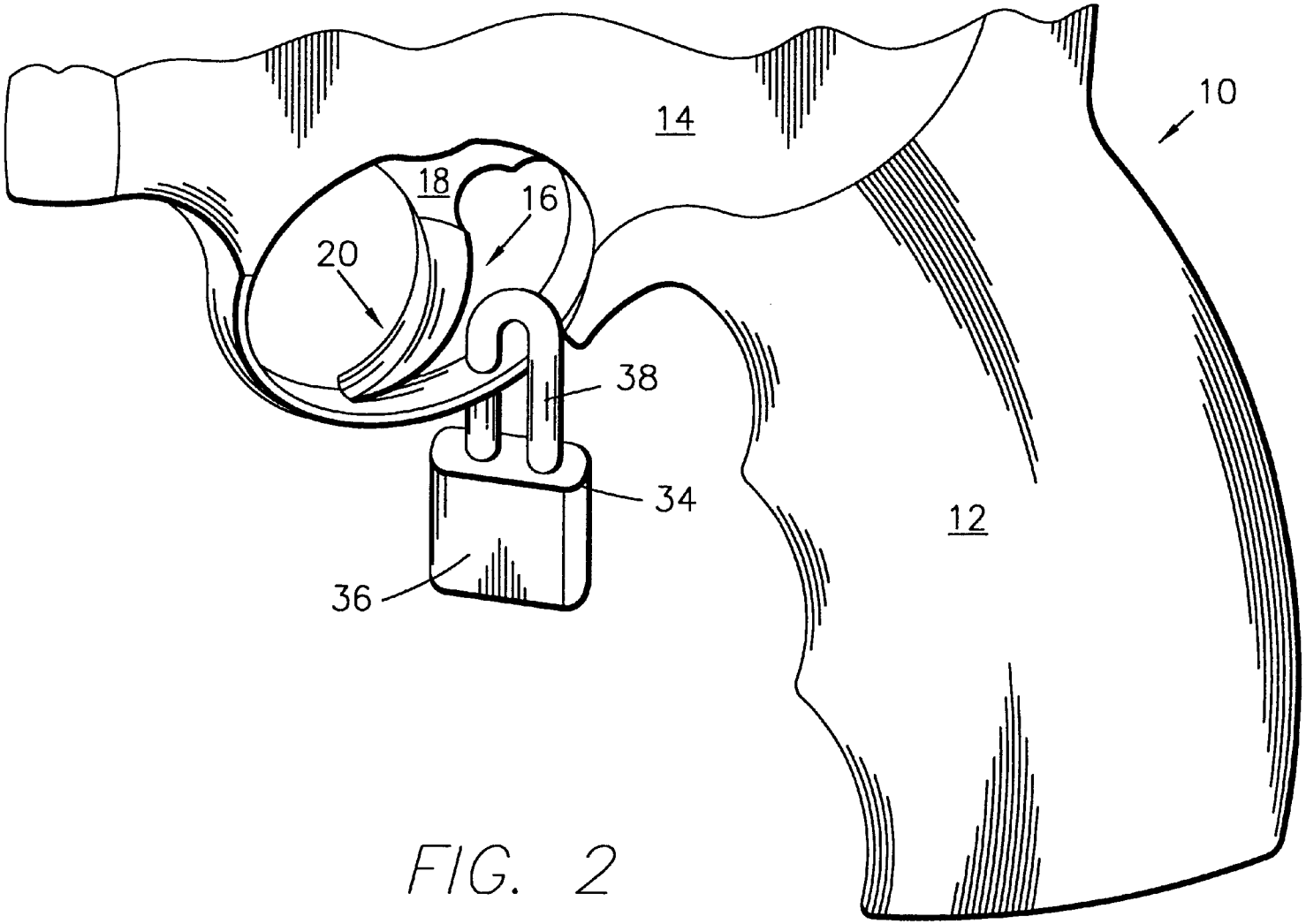
FIG. 2 is a partially fragmentary respective view of the firearm of FIG. 1 with the lock member secured in place through the discharge preventing opening.

In accordance with the invention, as illustrated in FIGS. 1 and 2, the trigger guard 22 has an internal substantially flat surface 24 and a similar outwardly disposed surface 26 which together define the thickness of the guard. The guard is made from a cast or forged steel which provides ample strength, for purposes of protecting the trigger from inadvertent discharge.

Formed in the trigger guard transversely through each of the parallel disposed surfaces 24 and 26 is a generally circular discharge preventing opening 30. The opening 30 is positioned substantially proximate to the forwardmost position of the trigger as illustrated in solid line so as to be located prior to the trigger piece 20 passing a point of discharge as dictated by the internalized trigger mechanism of the firearm.

In the preferred embodiment of the invention, the discharge preventing opening 30 has a diameter somewhat greater than ⅛ of an inch which still allows sufficient material to remain as part of the trigger guard and yet provides an anchor for preventing discharge of the firearm.

As seen in FIG. 2, the guard system of the present invention further includes a lock 34 having a lock mechanism disposed within a housing 36 thereof and an axially movable generally U-shaped shank member 38 which can be released to rotate freely around one of the shank members of the U-shape piece. In its secured condition, the shank members are secured within the locking openings of the lock in a rigid manner as illustrated in the drawings. In the preferred embodiment, the lock member 34 is a standard commercially available lock which is made by Samsonite (™) "Royal Traveler" under Part No. RT-02. The generally U-shaped member 38 of the lock 34 has a shank diameter of approximately 7/16 of an inch and the U portion of the shank has a radius of curvature of 7/32 of an inch. This curvature is important in that it is sufficient to interfere with the travel of the trigger piece 20 as it is moved between the illustrated solid and dotted lines shown in FIG. 1. Thus, the firearm 10 illustrated in FIG. 2 is made inoperative by virtue of the lock member 34 being locked in place in a position on the trigger guard located before trigger action would result in firing.

Figure 3:
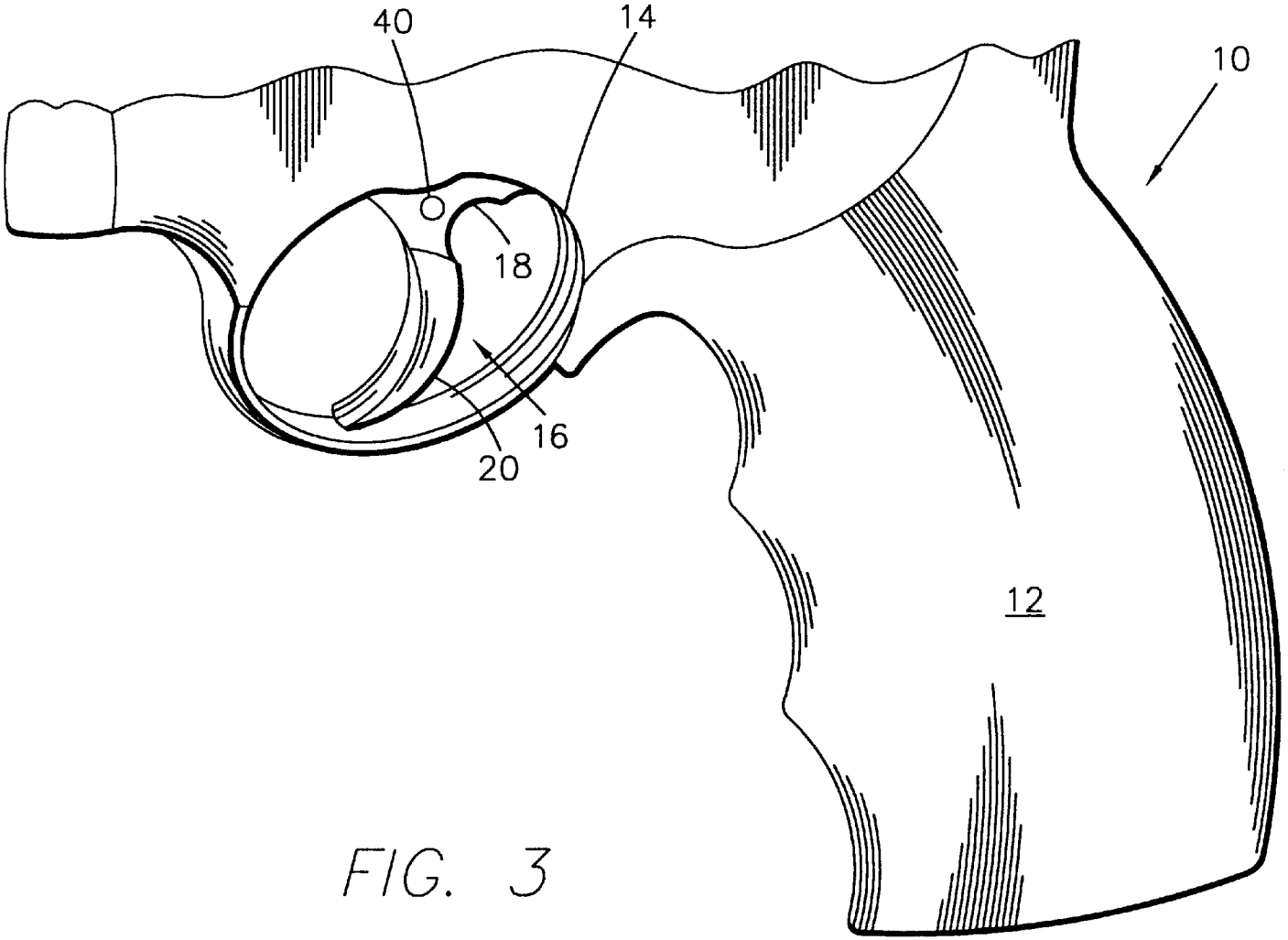
FIG. 3 is a partially fragmentary perspective view of a second embodiment the firearm with a discharge preventing opening formed in the trigger boss.
Figure 4:
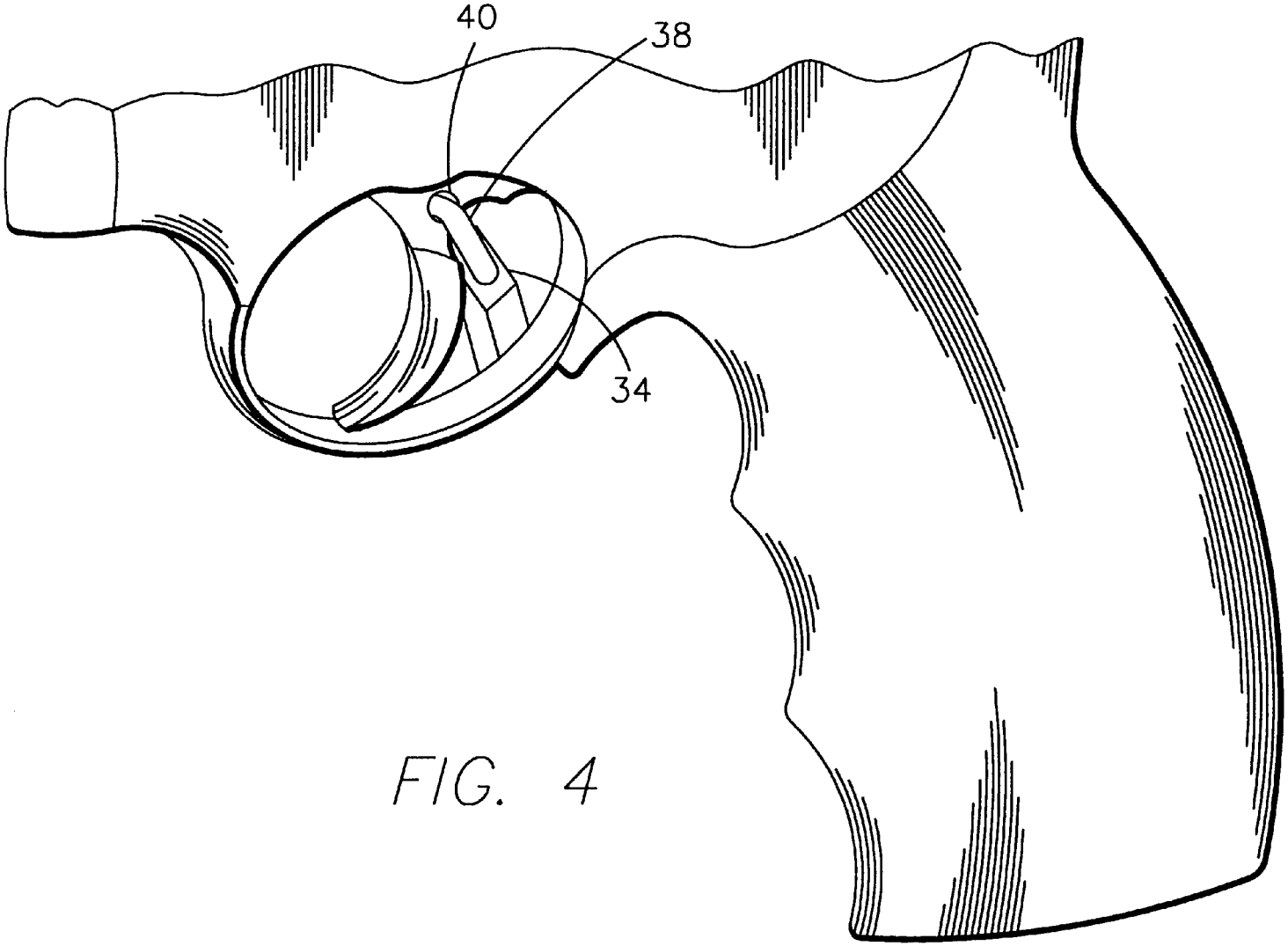
FIG. 4 is a partially fragmentary perspective view of the firearm shown in FIG. 3 with a lock member positioned through the discharge preventing opening in a secured manner.

Referring now to FIGS. 3 and 4, and to a second embodiment of the invention, it should be seen that the firearm shown 10 is a revolver type firearm with a pivotal type trigger 16. As previously mentioned, the trigger member 16 has a lower trigger piece 20 engageable by the firing digit of the user's hand and an integrally formed boss 18 which is sized to be received within the internalized components of the trigger mechanism. That is the boss 18 when the trigger is pulled to its firing condition as illustrated by the phantom line in FIG. 1, is moved into the internal cavity of the frame in which the trigger mechanism is housed. Thus the boss of the trigger member 16 is substantially exposed when the trigger is in its latent prefired condition and is moved into the internal cavity of the firearm when the trigger is pulled to the fired condition shown in phantom line of FIG. 1.

In accordance with a further object of the invention, a discharge preventing opening 40 is formed in the boss portion 18 of the trigger member 16 so as to be disposed tangentially or in very close proximity with the frame 14 of the firearm. As illustrated in FIG. 4, the opening 40 is again correspondingly sized and shaped to receive the shank member 38 of a lock member 34. In this way, the U-shaped member 38 of the lock can initially be unfastened from the lock housing 34, placed through the opening 40 in the boss portion 18 of the trigger member 16, and thereafter secured in place within the lock member 34 to prevent discharge of the firearm. Thus with the shank portion 38 of the lock member butted against the juxtaposed frame 14 of the firearm, the trigger cannot be inadvertently pulled toward the phantom line condition shown in FIG. 1.

Figure 5:
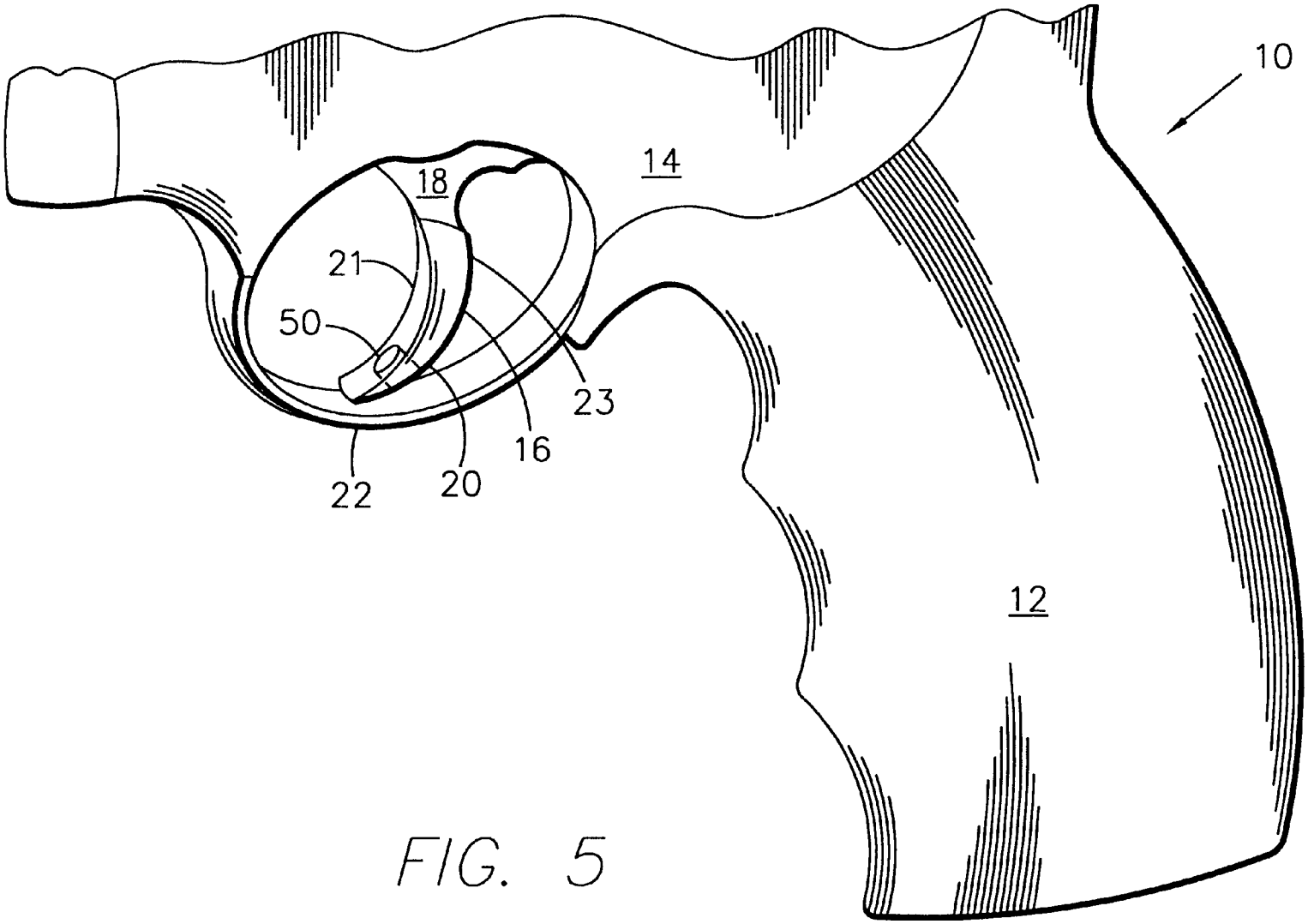
FIG. 5 is a partially fragmentary perspective view of a third embodiment of the invention wherein the discharge preventing opening is formed in the lower trigger member.
Figure 6:
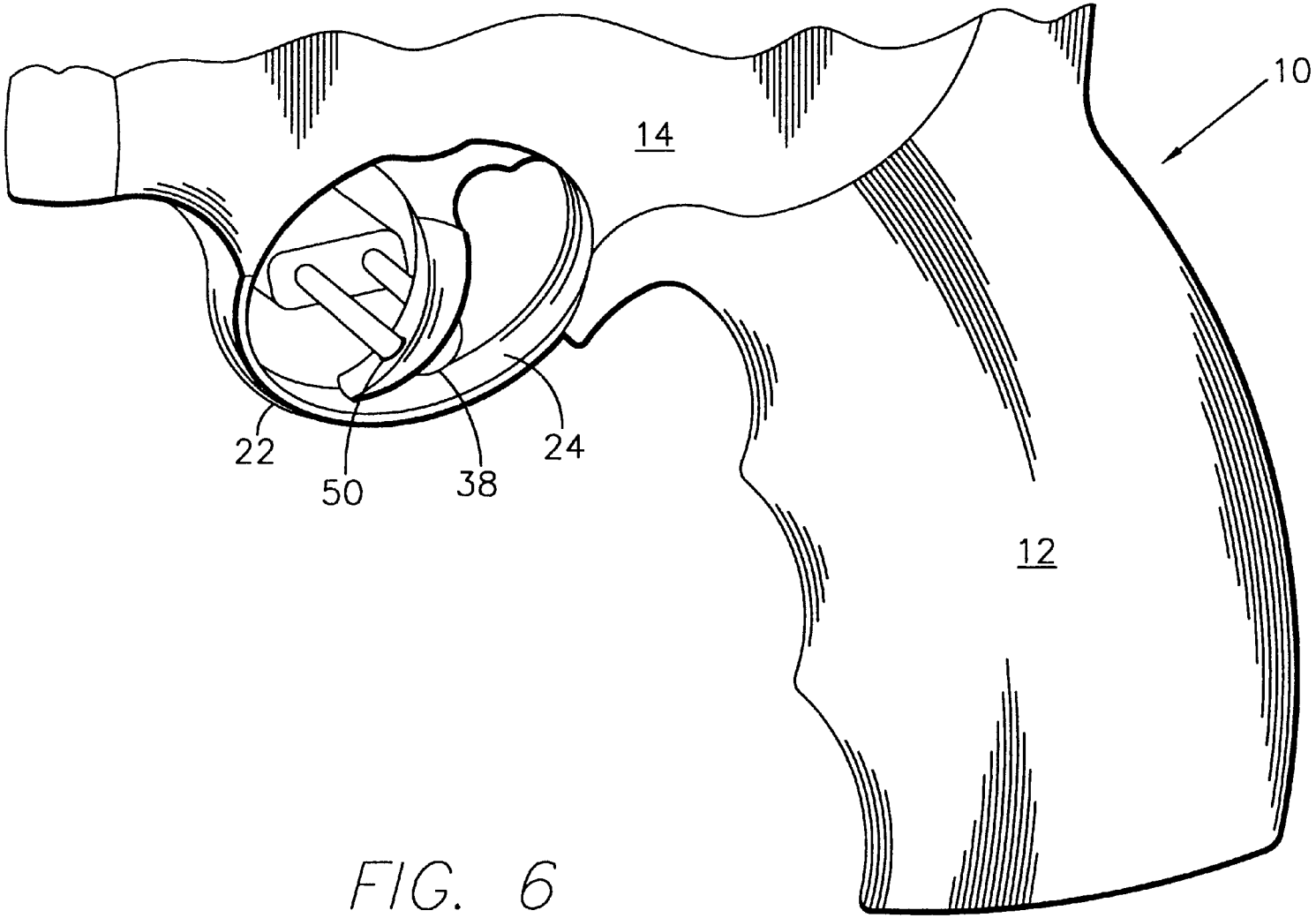
FIG. 6 is a partially fragmentary perspective view of the firearm shown in FIG. 5 with a lock member in place through the discharge preventing opening in a secured manner.

Referring now to FIGS. 5 and 6, a firearm 10 of the type discussed in FIG. 1 is shown. The firearm 10 likewise includes a trigger member 16 having a low trigger piece 20 which is integrally connected with a trigger boss 18 pivotally secured to the trigger mechanism within a cavity of the frame of the firearm. As illustrated in FIG. 5, a discharge preventing opening 50 is formed in the lower thickness of the trigger piece 20 and extends transversely through the forward trigger engagement surface 21 and into the corresponding rear surface 23.

The discharge preventing opening 50 as seen in FIG. 5 is formed such that the opening extends normally to the forward surface 21 in the illustrated manner. The opening 50 is likewise correspondingly sized and shaped to receive the corresponding diameter of the shank 38 of lock member 34 therewithin. The normalized orientation of the opening 50 in the trigger piece 20 is important in that it causes one of the shanks of the U-shaped member 38 to become jammed and wedged between the inner surface 24 of the trigger guard 26 in the event that the trigger member 16 is inadvertently pulled toward the firing position as shown in phantom in FIG. 1.

Referring now to FIGS. 7A–C and FIG. 8, a fourth embodiment of the invention is shown. In this embodiment, the firearm designated as 60 is a pistol having a frame 62, a handle 64 and a barrel connected to the frame and covered by a slide 66. The pistol 60 further includes a sliding trigger mechanism housed within a cavity of the frame 62 and a slide trigger 70 movable between a latent or prefired position shown in solid line in FIG. 7A and a fired position shown in phantom line in the same figure.

In further accordance with the invention, it should be seen that the slide trigger 70 has a given thickness TH (see FIG. 7C) as defined by opposed side wall 71,71 and through this thickness is formed a discharge preventing opening 80 transversely through the trigger. The discharge preventing opening 80 is located on the slide trigger such that a portion of the opening is disposed tangentially to the pistol frame 62. As illustrated in FIG. 8, the discharge preventing opening 80 is correspondingly sized and shaped to receive the U-shaped portion of the shank 38 of the lock member 34 such that the lock can be secured around the frame in the manner shown in FIG. 8.

Figure 7A:
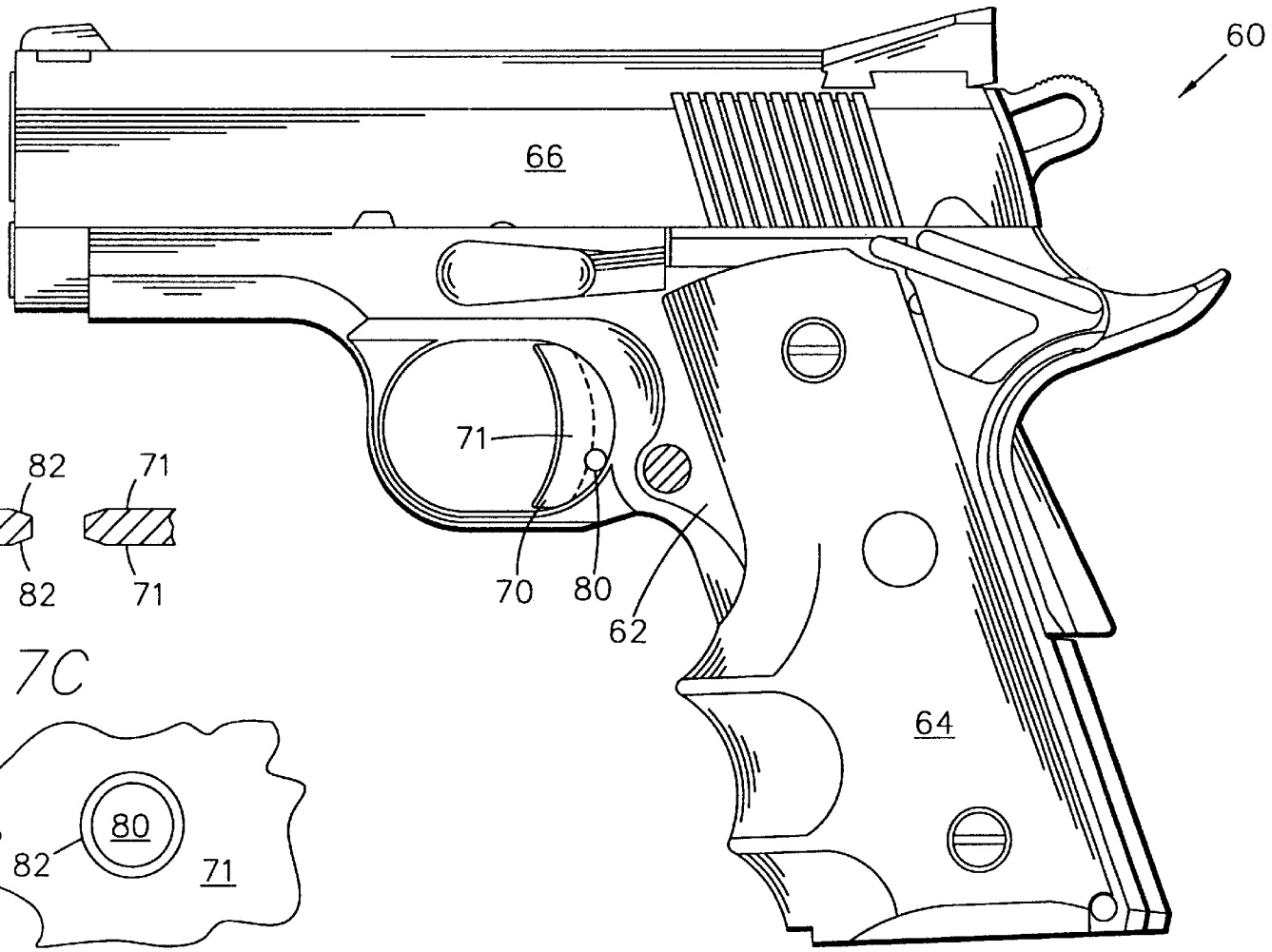
FIG. 7A is a side elevation view of a fourth embodiment employing a firearm pistol with a discharge preventing opening formed in the slide trigger thereof.
Figure 7B:
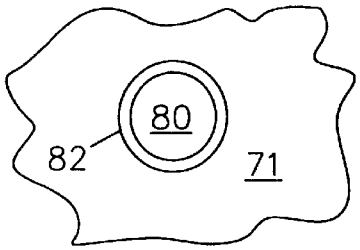
FIG. 7B is a partially fragmentary side elevation view of a portion of the slide trigger shown in FIG. 7A illustrated in detail.
Figure 7C:
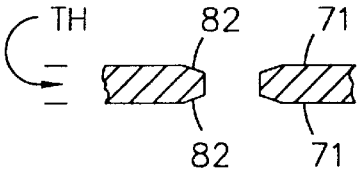
FIG. 7C is a horizontal section taken through the opening shown in FIG. 7B.
Figure 8:
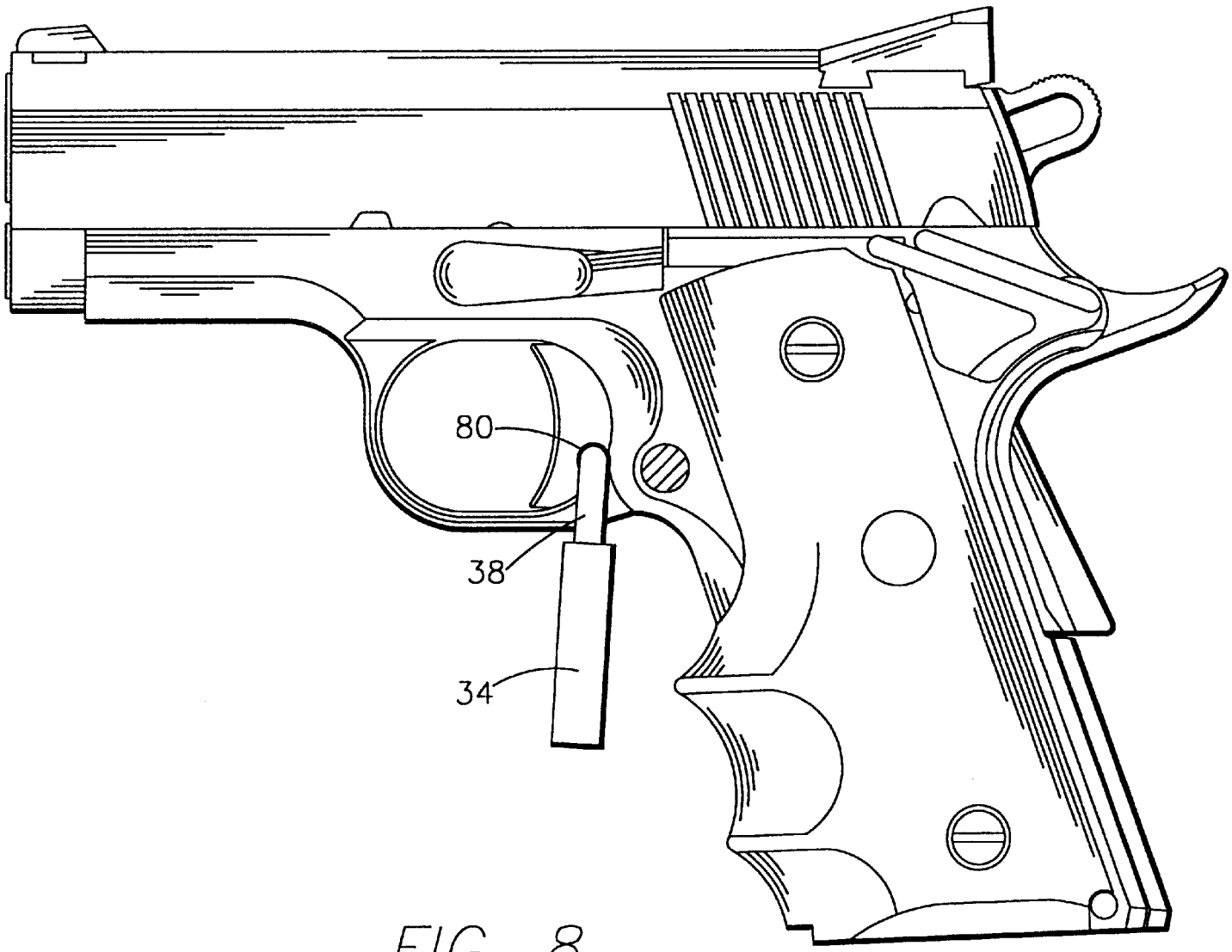
FIG. 8 is a side elevation view of the pistol shown in FIG. 7A with a lock member secured in place within the discharge preventing opening.

As illustrated in FIGS. 7B and 7C, it has been found, however, that the discharge preventing opening 80 in the slide trigger 70 of the pistol 60 is best formed with a countersink bore 82 formed around the perimeter of the opening 80. This countersink allows for a generally annular taper to surround the opening 80 and thereby allow the U-shaped portion of the shank 38 to be moved through the opening and into the generally vertical position as illustrated in FIG. 8.

Figure 9:
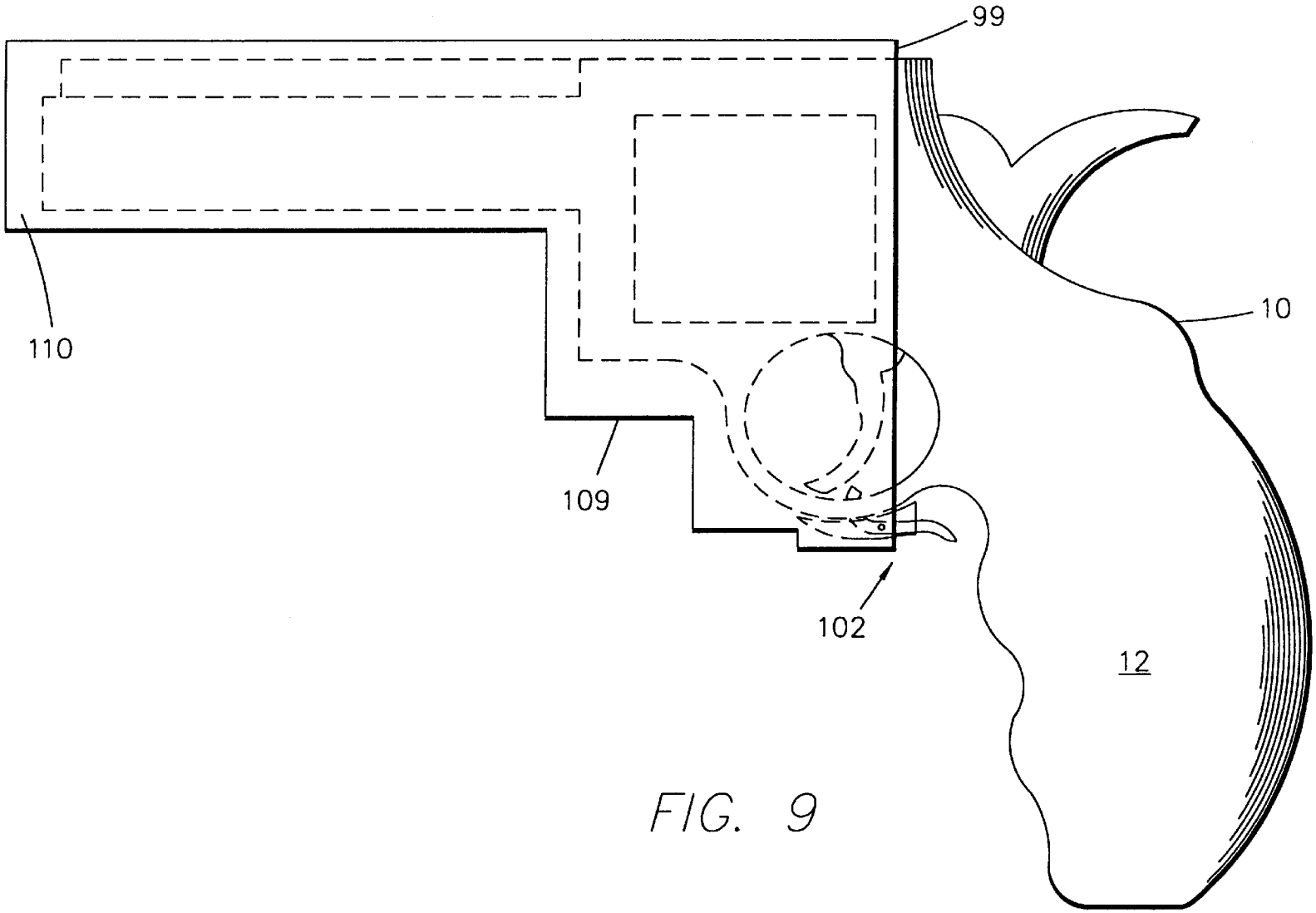
FIG. 9 is a fifth embodiment of the invention showing in side elevation view of the firearm shown in FIG. 1 holstered with a lock mechanism of the present invention engaging within the discharge preventing opening thereof.
Figure 10:
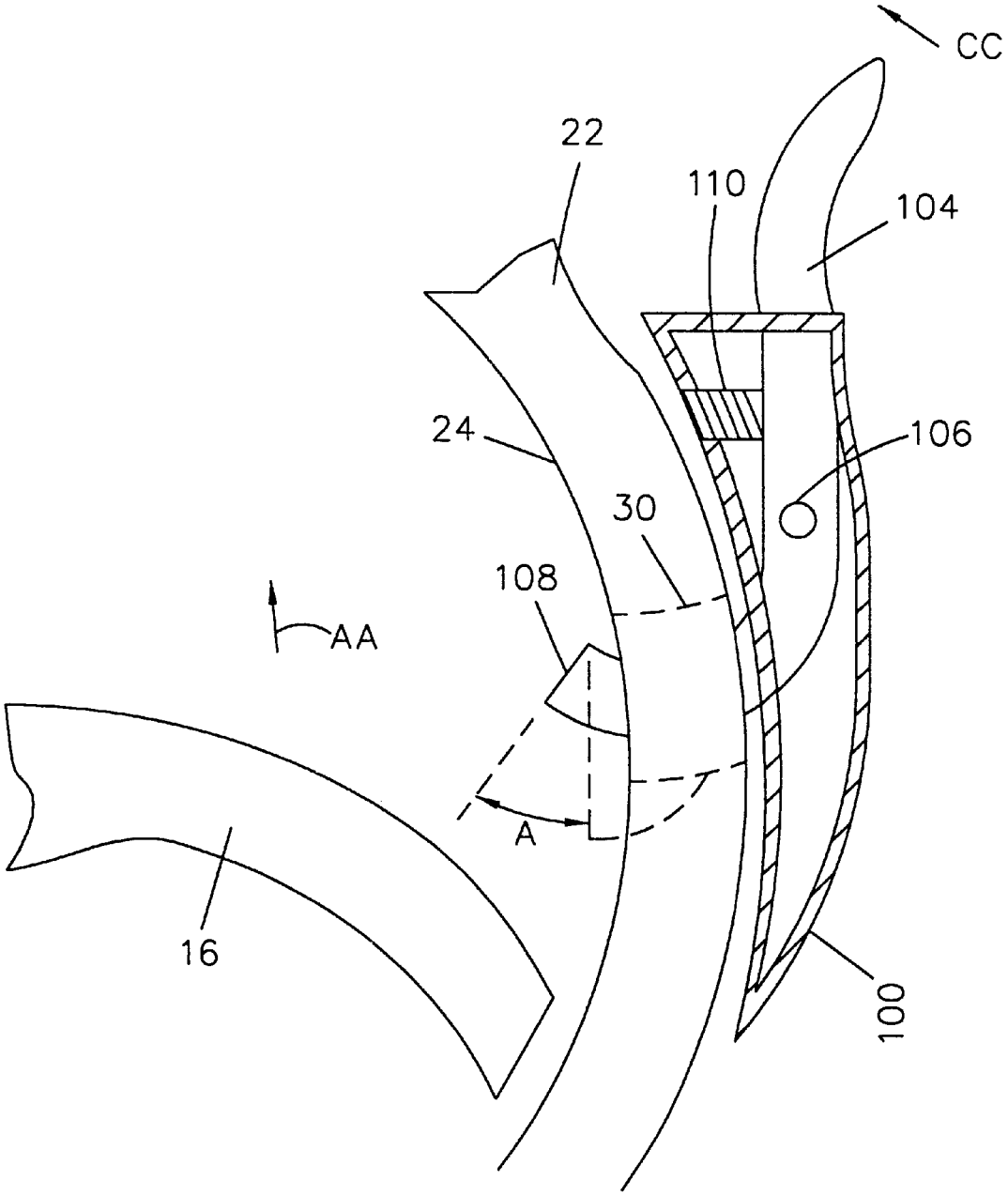
FIG. 10 is a partially fragmentary detail view of the lock mechanism shown in FIG. 9.

Referring now to FIGS. 9 and 10 and to a fifth embodiment of the invention, it should be seen that a holster 100 having a top opened end 99 is provided with a lock mechanism 102 in the vicinity of where the handle of the firearm would be placed. The firearm illustrated is one such as disclosed and illustrated in FIG. 1 wherein the discharge preventing opening is formed on the trigger guard 22 in the manner discussed above. As seen in FIG. 10, the lock mechanism 102 includes a bell crank 104 pivotally secured to the holster at pivot point 106 and includes a projecting portion 108 which is biased laterally outwardly toward the holster cavity by a coil spring 110 acting between the bell crank 104 and the holster 100.

As illustrated in FIG. 10, the projecting portion 108 is angled outwardly at the illustrated angle A which cooperates with the corresponding curvature of the outer surface 26 of the trigger guard 22 to counter rotate the bell crank lock 104 in the illustrated CC direction so as to displace the projection 108 outwardly of the holster chamber as the firearm 10 is being moved into the holster void or chamber 110. As this is occurring, the discharge preventing opening 30 formed in the trigger guard 22 becomes aligned with the otherwise outwardly biased projection 108 of the lock belt crank 104 and allows the projection 108 to pass through the opening 30 and to project beyond the inner surface 24 of the trigger guard 22 to lock the firearm in place.

The length of the trigger guard projection portion 108 which extends inwardly beyond the trigger guard inner surface 24 further causes a blocking action to occur with any movement of the trigger member 16 occur in the direction of firing indicated in FIG. 10 as aa. Thus, the lock mechanism 102 not only provides a means for securing the firearm 10 within the holster, but further provides a means for preventing inadvertent firing of the firearm while holstered.

By the foregoing an improved firearm guard has been described by way of illustration however, numerous modifications or substitutions may be had without departing from the spirit of the invention. For example, the invention has been disclosed by with reference to a trigger guard as found in a hand held firearm, but the invention is also adaptable to be used corresponding structure in, for example, a rifle trigger assembly.

Accordingly, the invention is being described by way of illustration rather than limitation.

What is claimed is:

1. A holster comprising:

a housing defining generally a chamber which is shaped to receive the corresponding shape of a firearm;

a lock mechanism disposed on said holster generally adjacent the point where a trigger guard of a firearm would be located when a firearm is seated within said chamber;

said lock mechanism having a spring loaded bell crank which is biased inwardly toward said chamber and includes a projection portion thereon which is displaceable between an outwardly extending position corresponding to a locked condition of said lock mechanism and an inwardly retracted position corresponding to when a firearm is being moved into place within said holster.

2. A holster as defined in claim 1 further characterized by said lock mechanism bell crank is an S-shaped bell crank which has an angled face which faces the opening of said chamber when a firearm is being placed therein.

* * * * *